US011136800B2

(12) United States Patent
Larsen

(10) Patent No.: US 11,136,800 B2
(45) Date of Patent: Oct. 5, 2021

(54) GATE ROLLER WITH TAPERED SIDE WALLS AND RELATED METHODS

(71) Applicant: Charles Larsen, Huntington Beach, CA (US)

(72) Inventor: Charles Larsen, Huntington Beach, CA (US)

( * ) Notice: Subject to any disclaimer, the term of this patent is extended or adjusted under 35 U.S.C. 154(b) by 1092 days.

(21) Appl. No.: 14/348,561

(22) PCT Filed: Oct. 1, 2012

(86) PCT No.: PCT/US2012/058348

§ 371 (c)(1),
(2) Date: Mar. 28, 2014

(87) PCT Pub. No.: WO2013/049840

PCT Pub. Date: Apr. 4, 2013

(65) Prior Publication Data

US 2014/0223827 A1 Aug. 14, 2014

Related U.S. Application Data

(60) Provisional application No. 61/541,392, filed on Sep. 30, 2011.

(51) Int. Cl.

| | |
|---|---|
| ***E05D 13/00*** | (2006.01) |
| ***E06B 11/04*** | (2006.01) |
| ***E05D 15/06*** | (2006.01) |

(52) U.S. Cl.

CPC ..... *E05D 13/00* (2013.01); *E05D 15/0621* (2013.01); *E06B 11/045* (2013.01); *E05D 15/0617* (2013.01); *Y10T 16/384* (2015.01)

(58) Field of Classification Search

CPC . E05D 13/00; E05D 15/0621; E05D 15/0617; E06B 11/045; Y10T 16/384

USPC ..... 49/404, 425; 242/615.4

See application file for complete search history.

(56) References Cited

U.S. PATENT DOCUMENTS

| | | | | |
|---|---|---|---|---|
| 321,708 A | | 7/1885 | Gardner | |
| 771,766 A | * | 10/1904 | Burkholder | E05D 15/063 16/94 R |
| 3,033,285 A | | 5/1962 | Banner | |
| 3,045,538 A | * | 7/1962 | Kotte | G03B 1/56 242/157 R |

(Continued)

FOREIGN PATENT DOCUMENTS

| | | | | |
|---|---|---|---|---|
| EP | 0134824 A1 | * | 3/1985 | E05D 15/0617 |
| EP | 0497137 | | 8/1992 | |

(Continued)

OTHER PUBLICATIONS

Idler pulley for slag conveyor; derwent No. 2008-G08345, inventor Jiang, priority data date-2007CN-20018374, Jan. 31, 2007, publication date Jan. 2, 2008 (attached: 1 page of figure, 1 page of title with abstract=2 pages total).*

*Primary Examiner* — Jerry E Redman
(74) *Attorney, Agent, or Firm* — J. Mark Holland + Associates; J. Mark Holland; Alison Adnan

(57) ABSTRACT

A roller facilitates movement of a gate or similar barrier between a first and second position. The barrier fits at least generally within a channel formed at the periphery of the roller, and the channel is shaped to reduce the contact area and resulting friction that can otherwise occur between the confronting surfaces of the channel and the barrier.

5 Claims, 7 Drawing Sheets

(56) References Cited

U.S. PATENT DOCUMENTS 3,446,410 A * 5/1969 Brose ..... G03D 5/00 118/235
3,473,266 A * 10/1969 Miller ..... E05D 15/06 16/87 R
3,524,607 A * 8/1970 Falk ..... G11B 15/29 226/191
3,725,606 A * 4/1973 Thompson ..... G11B 15/61 226/184
3,886,685 A * 6/1975 Riphagen ..... E05D 15/1021 49/209
3,907,234 A * 9/1975 Sato ..... G11B 23/07 226/190
3,925,933 A * 12/1975 Reuter ..... E05D 15/0626 16/87 R
4,225,097 A * 9/1980 Ohtomo ..... G03D 3/13 226/118.1
4,898,567 A * 2/1990 Tatara ..... F16G 5/18 474/174
5,022,185 A * 6/1991 Oatman ..... E05D 15/0617 49/404
5,528,862 A * 6/1996 Streeter ..... E05D 15/066 49/404
6,176,493 B1 1/2001 Whipps
6,253,492 B1 * 7/2001 Finke ..... E05D 1/06 16/87.4 R
6,446,394 B1 * 9/2002 Finke ..... E05D 15/0652 49/409
6,516,566 B2 * 2/2003 Finke ..... E05D 15/0652 49/127
7,228,659 B2 * 6/2007 Romero ..... E05D 15/0626 16/268
8,393,114 B2 * 3/2013 Haab ..... E05D 15/0652 16/102
9,003,713 B2 * 4/2015 Dries ..... E05D 13/04 49/409
9,316,261 B2 * 4/2016 Dellupi ..... F16C 39/02
2005/0101424 A1 * 5/2005 Van Der Sluis ..... F16G 5/16 474/242
2005/0221938 A1 * 10/2005 Yoshida ..... F16G 5/16 474/242
2011/0166003 A1 * 7/2011 Brice ..... A63B 21/00 482/131
2012/0021859 A1 * 1/2012 Faes ..... F16G 5/16 474/240
2013/0303316 A1 * 11/2013 Sano ..... F16G 5/16 474/8
2016/0319917 A1 * 11/2016 Van Der Meer ..... F16G 5/16
2018/0023664 A1 * 1/2018 Bransma ..... F16H 9/18 474/8
2018/0314302 A1 * 11/2018 Gopalan ..... G06F 1/1647
2019/0003555 A1 * 1/2019 Ishiguro ..... C08L 11/00

FOREIGN PATENT DOCUMENTS

FR 2513688 A1 * 4/1983 ..... E05D 15/0617
GB 625761 A * 7/1949 ..... E05D 13/00
WO WO2009121468 10/2009

* cited by examiner

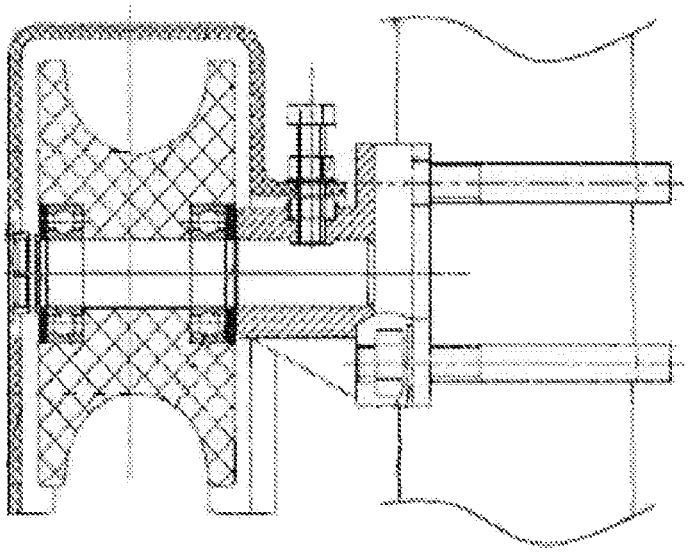
FIG. 5 – PRIOR ART
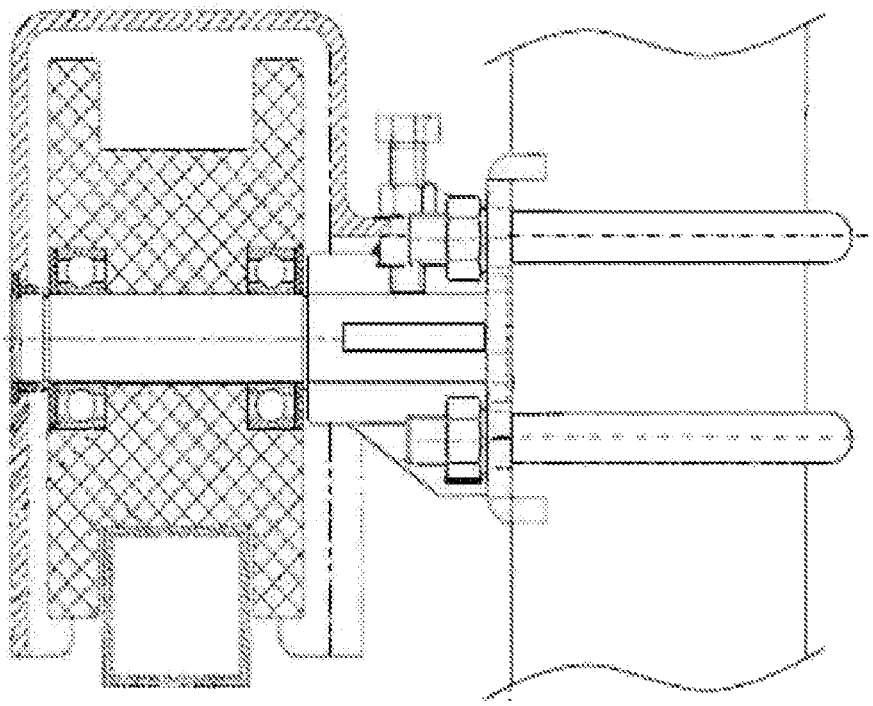
FIG. 6 – PRIOR ART

GATE ROLLER WITH TAPERED SIDE WALLS AND RELATED METHODS

FIELD OF THE INVENTION

This invention relates to gate suspension systems and components, such as gate rollers, and related methods.

BACKGROUND OF THE INVENTION

Cantilever gates have been a staple in the fence industry for many years. These gates are especially useful in situations where other solutions to support the gate (such as ground rollers, ground track, or overhead track) as it traverses the opening are not practical or desirable. Such situations can occur due to uneven terrain, overhead clearance requirements, or the potential for ice or snow interfering with ground supported configurations.

Such gates are used in a wide variety of applications, including (by way of example) gated communities, commercial, industrial, and other security-type installations. One common cantilever gate design incorporates four or more rollers within which the upper and lower horizontal frame members of the gate are positioned within channels formed in the rollers. Although the predominant configuration of the gates in these applications has been chain link attached to a frame made from round tubular members, such gates have more recently begun to be made from square or rectangular tubular members, at least in part to meet a growing demand for gates having a more ornamental style.

Typically, the rollers for these gates (which facilitate the gates' movement between open and closed positions) have been fashioned with channels in the rollers that are shaped to correspond to the shape of the gate frame member on which the gate is intended to be used. This allows the roller to be seated securely and not become dislodged from its intended movement track. Thus, for the conventional round tubing frame covered with chain link, the channel track. Thus, for the conventional round tubing frame covered with chain link, the channel roughly approximates a half-circle. For other shapes of gate frame members (such as those with square or rectangular cross-sectional shapes), the roller channel typically is formed with a corresponding square/rectangular shape.

FIGS. 5 and 6 show examples of prior art square and round rollers. In cross-section, the roller of FIG. 5 is mounted to rotate on an axle, and includes a generally round channel to receive a generally correspondingly-shaped gate member. FIG. 6, likewise in cross-section, illustrates the same for a confronting interface between a roller and a gate element that are both generally square. Many other roller systems use those same basic designs for the roller shapes, although they may have differences in materials, bracket design, axle mount configuration, or other features.

Gate frame members with non-round cross-sections typically have a flat/horizontal load-bearing surface, and perpendicular (generally vertical) sidewalls. This design functions and currently is the standard practice in the industry, but it has some shortcomings. Among other things, as any of these gates (whether they have round or non-round frames) travels there is a tendency for the gate to drift side-to-side, laterally to the gate's intended travel path. Weather conditions (such as a cross-wind) can exacerbate that lateral movement. Any such lateral movement can result in undesired frictional rubbing between the confronting vertical sidewalls of the roller and the gate frame. The more extreme the wind, the more friction can occur. Besides generating excessive wear and damaging the paint or other finishes on those rubbing surfaces, that undesirable friction can increase the energy required to move the gate along the track, adding to the power requirements for the installation and causing correspondingly excessive loads on the motor that moves the gate. In certain installations and conditions, the undesired rubbing can even generate irritating or even potentially harmful noise.

BRIEF DESCRIPTION OF THE DRAWINGS

FIG. 5 is a sectional view of a prior art roller assembly, illustrating how the roller channel can be shaped to cooperates with a round gate frame member.

FIG. 6 is a sectional view of another prior art roller assembly, illustrating how the roller is shaped and is cooperating with a rectangular gate frame member (the frame member is the square near the bottom left of the drawing, on which the roller is resting).

DETAILED DESCRIPTION

Figure 1:
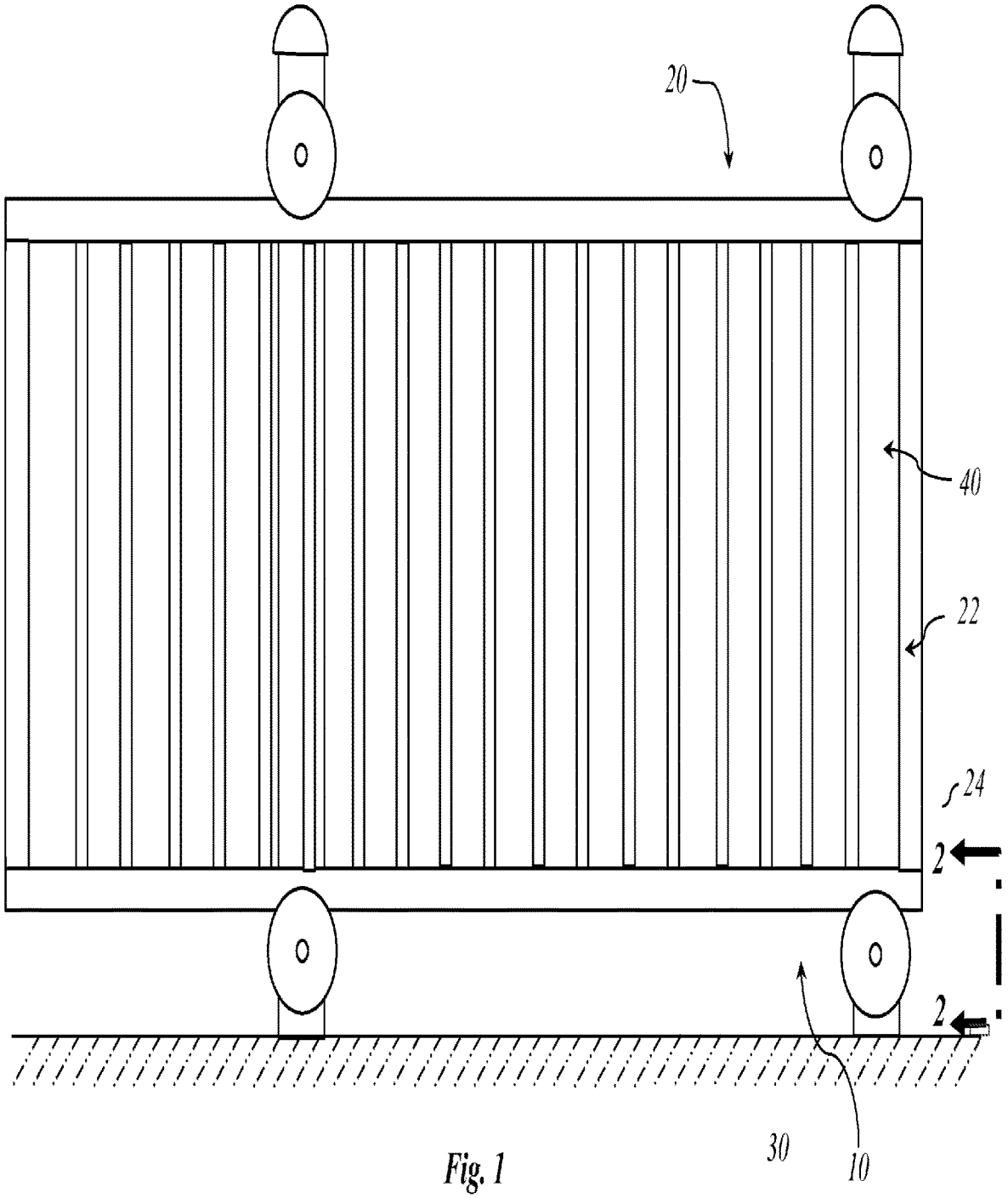
FIG. 1 is a side view of a picket style cantilever sliding gate incorporating an embodiment of the invention.

Embodiments of the present invention will now be described with references to the accompanying figures, wherein like reference numerals refer to like elements throughout. The terminology used in the description presented herein is not intended to be interpreted in any limited or restrictive manner, simply because it is being utilized in conjunction with a detailed description of certain embodiments of the invention. Furthermore, various embodiments of the invention (whether or not specifically described herein) may include novel features, no single one of which is solely responsible for its desirable attributes or which is essential to practicing the invention herein described.

Although the examples of the many various methods of the invention are described herein with steps occurring in a certain order, the specific order of the steps, or any continuation or interruption between steps, is not necessarily intended to be required for any given method of practicing the invention.

As illustrated in the drawings, the invention preferably substantially reduces or even eliminates contact between the confronting sidewalls of the roller channel and the gate frame. Among other benefits, this substantially reduces the friction and corresponding wear on those surfaces, as well as the noise that can be generated by that rubbing. It also can reduce the energy and maintenance requirements for automated gate systems in which the invention is used, and can reduce the related maintenance requirements for the gate itself.

Figure 2:
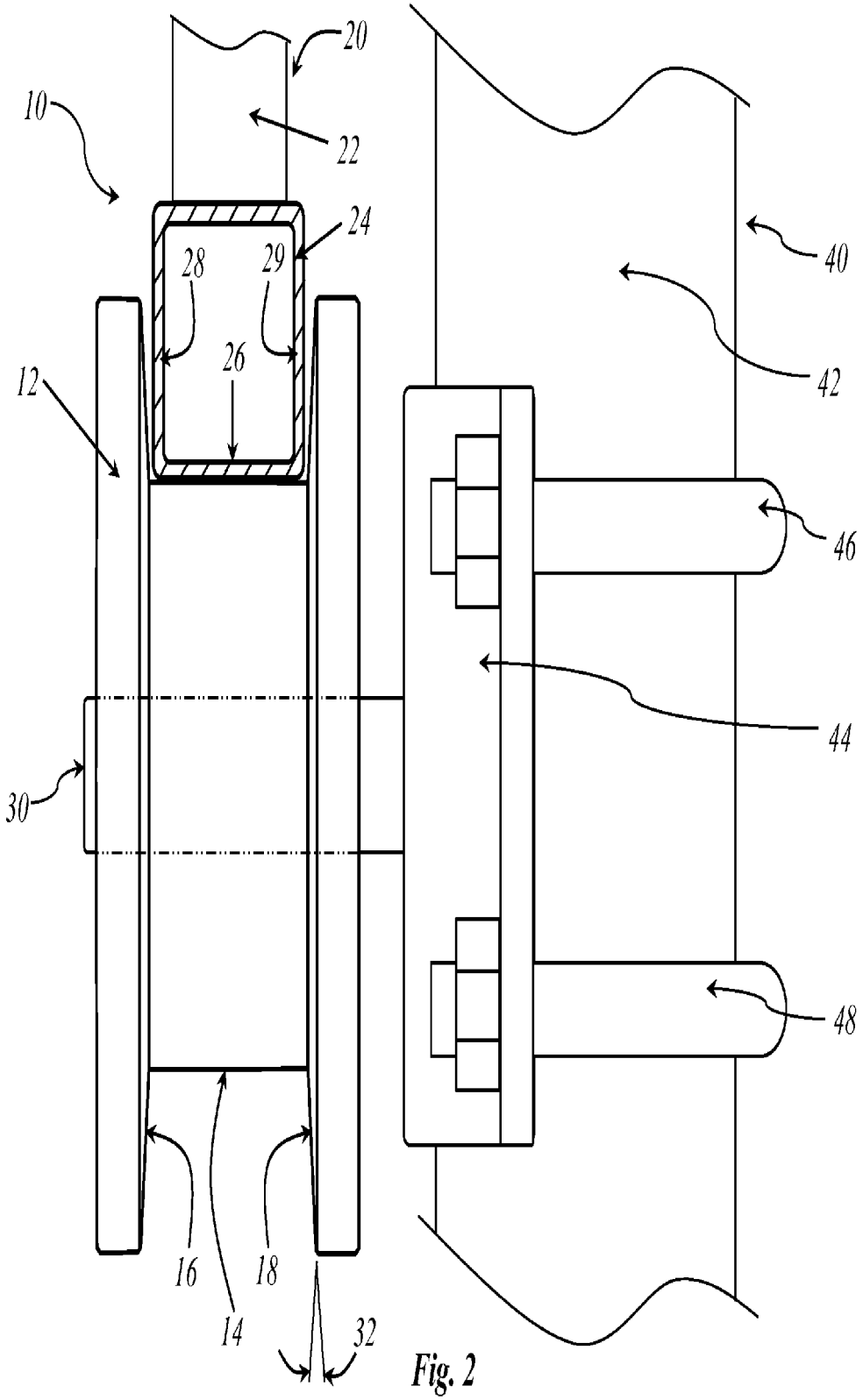
FIG. 2 is a cross sectional view of a gate incorporating square or rectangular upper and lower members showing the claimed roller of the roller assembly with a pocket or channel formed in the roller, and illustrating the flat surface of the gate being supported on the flat surface of the roller pocket with the sidewall of said roller formed at an angle at least slightly off of vertical, making the radially outer horizontal dimension of the roller pocket/channel wider than the innermost portion of the roller pocket.
Figure 4:
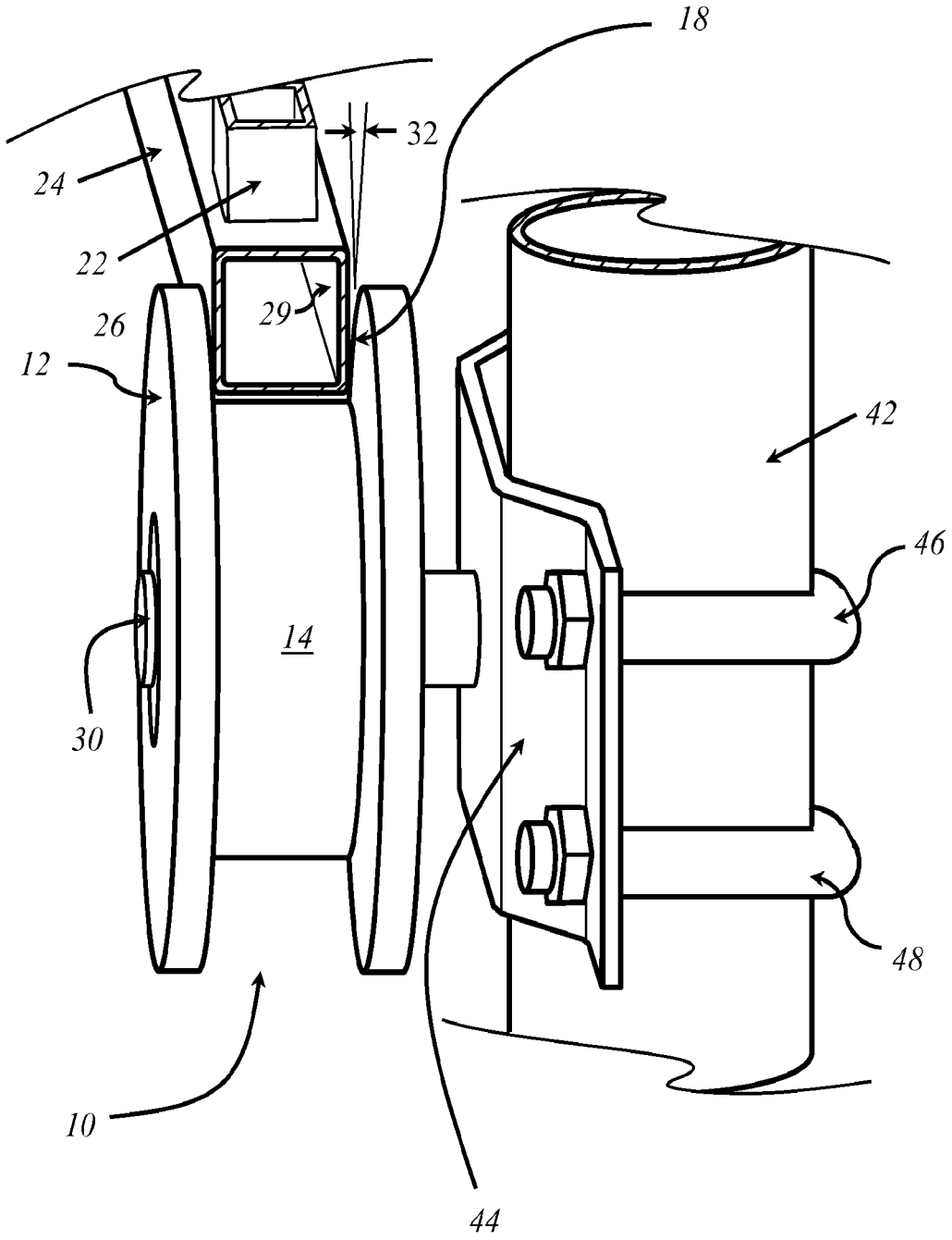
FIG. 4 is a cropped perspective view of the roller showing how the roller cooperates with a rectangular gate member.

The channel of the invention preferably has tapered sides 16 and 18 (rather than substantially vertical sides as shown in the prior art of FIG. 6), but can be in any shape suitable for reducing the contact area that can otherwise occur if the confronting surfaces are both substantially vertical. Persons of ordinary skill in the art will understand that the degree of taper can vary depending on the application and other factors. Although the drawings show a relatively small amount of taper (indicated by angle 32 in FIGS. 2 and 4), a greater or perhaps even lesser amount of tapering may be useful in certain applications.

Figure 7:
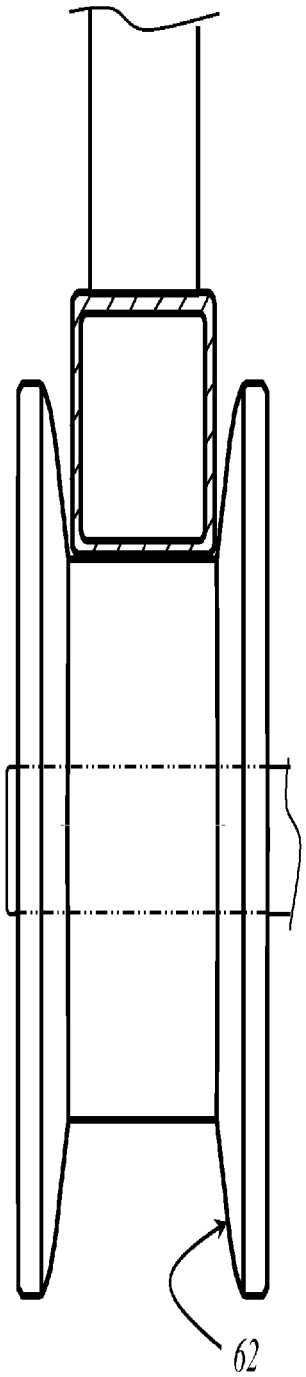
FIG. 7 is a cross sectional view of a gate incorporating square or rectangular upper and lower members showing an alternative embodiment of a roller of the roller assembly having a reduced contact surface shape.
Figure 8:
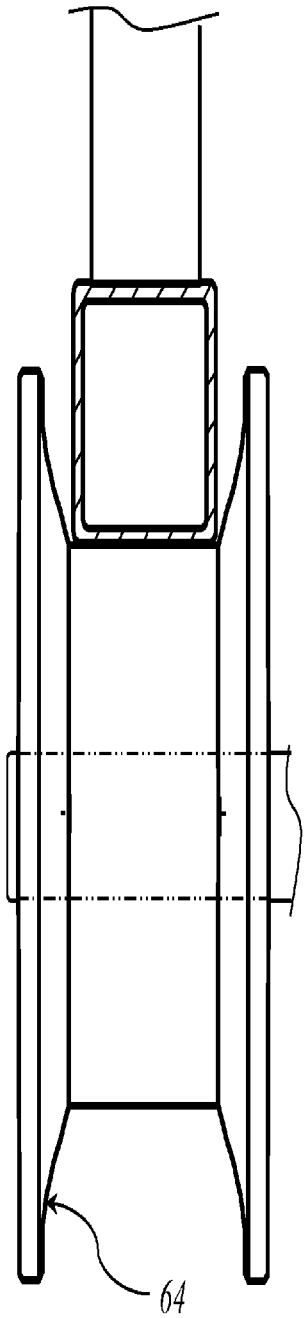
FIG. 8 is similar to FIG. 7, showing yet another embodiment of a roller of the roller assembly of the present invention.

FIGS. 7 and 8 illustrate just two more of the many alternative "reduced contact" surface shapes that can be used to practice the invention. In FIG. 7, portion 62 provides a slight concave surface as the tapered area 16 approaches its radially outermost point. In FIG. 8, portion 64 provides a slight convex surface as the tapered area 16 approaches its radially outermost point. Persons of ordinary skill in the art will understand that one side could have a shape or contour that was different than the other side of the roller, and still provide many of the benefits of the invention.

Figure 9:
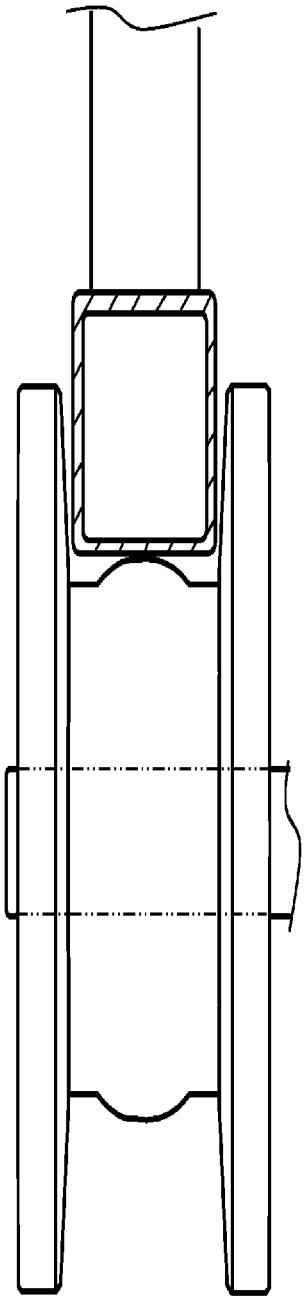
FIGS. 9, 10 and 11 show additional alternative embodiments of a roller of the present invention.
Figure 10:
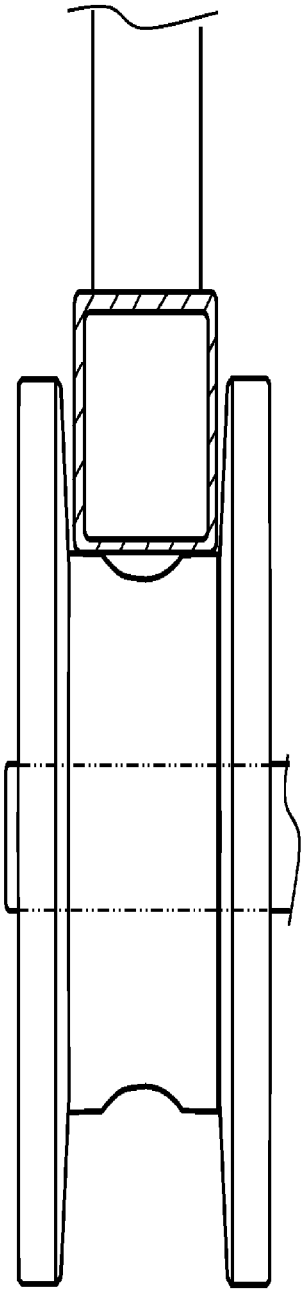
Figure 11:
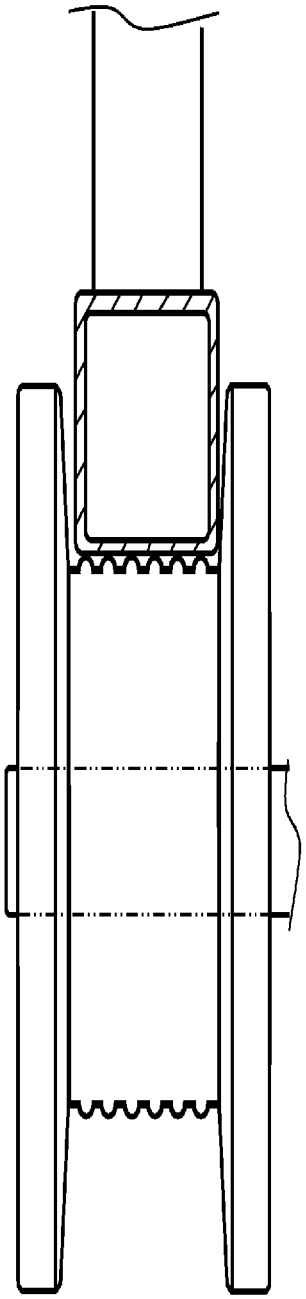

FIGS. 9, 10 & 11 are cross sectional views of a gate incorporating square or rectangular upper and lower members showing the roller of the roller assembly with a pocket or channel formed in the roller, and illustrating the flat surface of the gate being supported on a substantially horizontal surface of the roller pocket, said surface incorporating relief recesses with the sidewall of said roller formed at an angle at least slightly off of vertical, making the radially outer horizontal dimension of the roller pocket/channel wider than the innermost portion of the roller pocket.

Figure 3:
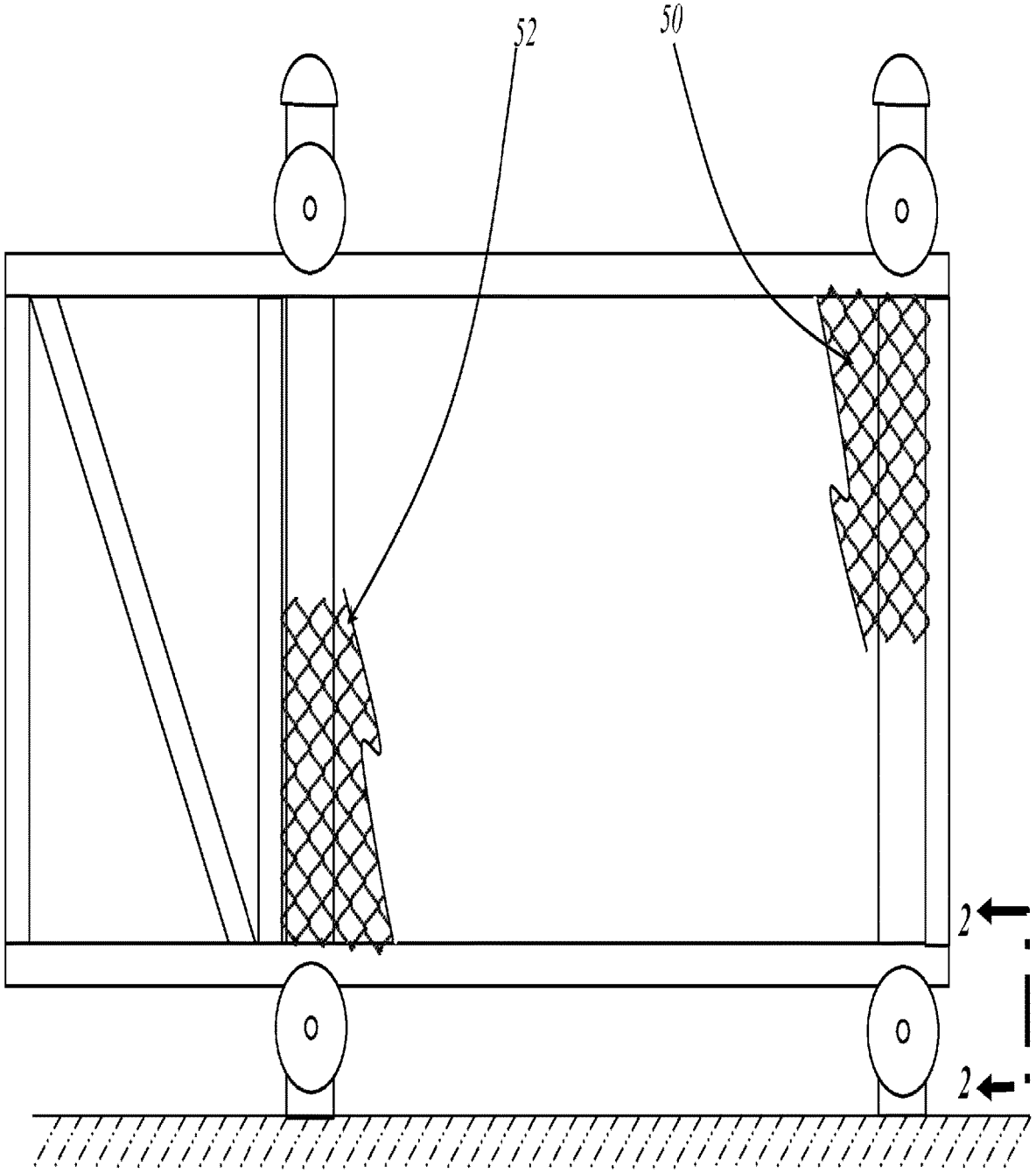
FIG. 3 is a side view of a chain link style cantilever sliding gate (chain link indicated as cropped elements 50 and 52) incorporating the invention.

In FIG. 1, a gate assembly 10 preferably includes at least one roller 12 mounted on an axle 30, which is turn is mounted on a support apparatus 40 such as a pole 42. Mounting bracket 44 is affixed to the pole 42 via bolts 46 and 48, and holds axle 30 at a desired vertical position for receiving the barrier 20 in the roller's channel 14/16/18. The barrier can be any of a wide range of apparatus, including ones having generally horizontal elements 24 and generally vertical elements 24 forming a generally rectangular assembly 20. As indicated above, other materials (such as chain link indicated as cropped elements 50 and 52 in FIG. 3) can be used in place of or in addition to vertical elements 22.

The materials and dimensions for manufacturing and practicing the invention can be selected from a wide variety, depending on a number of factors (such as economics, environment in which the gate will be deployed, size of the gate, etc.). Persons of ordinary skill in the art will understand that the specific configurations and assemblies in which the invention is provided can likewise be any of a broad range.

The invention claimed is:

1. An access control barrier assembly including:

a generally planar barrier element movable between a first position and a second position, said barrier element having one or both of an upper lateral edge member and a lower lateral edge member that has a rectangular cross-section;

a plurality of unitary rollers spaced from each other and each having an axis of rotation and a guiding channel formed at the perimeter of said rollers, said guiding channels configured and positioned to guide and facilitate movement of said barrier element;

said channels each having a center portion and at least one tapered side portion when viewed in cross-section, said at least one side portion extending generally radially outwardly from said axis of rotation in a path other than orthogonal to said axis of rotation.

2. A gate assembly, comprising:

a barrier element configured to be moved between a first position blocking passage and a second position permitting passage, said barrier having a planar exterior edge with two perpendicular sidewalls extending therefrom;

a plurality of rollers spaced from each other and supporting said barrier element and facilitating movement of said barrier element between said first position and said second position, each roller configured to rotate in coordination with lateral movement of an associated gate;

a channel formed at a periphery of said roller, said channel having a substantially horizontal center portion when viewed in cross-section, a flat surface of the gate being supported on said substantially horizontal center portion of the channel, said center portion incorporating a sidewall of said roller formed at a non-vertical angle, wherein a radially outer horizontal dimension of the channel is wider than an innermost portion of said channel.

3. The gate assembly of claim 2, wherein each roller is fabricated as a unitary body.

4. A gate assembly, comprising:

a barrier element configured to be moved between a first position blocking passage and a second position permitting passage;

a plurality of rollers spaced from each other and supporting said barrier element and facilitating movement of said barrier element between said first position and said second position, each roller having a unitary body configured to rotate in coordination with lateral movement of an associated gate, a channel formed at a periphery of said unitary body, said channel having a substantially horizontal center portion when viewed in cross-section, a flat surface of the gate being supported on said substantially horizontal center portion of the channel, said center portion incorporating a sidewall of said roller formed at a non-vertical angle, wherein a radially outer horizontal dimension of the channel is wider than an innermost portion of said channel.

5. An access control barrier assembly including:

a generally planar barrier element movable between a first position and a second position;

a plurality of unitary rollers spaced from each other and each having an axis of rotation and a guiding channel formed at a perimeter of said rollers, said guiding channels configured and positioned to guide and facilitate movement of said barrier element;

said channel having a center portion and at least one tapered side portion when viewed in cross-section, said at least one side portion extending generally radially outwardly from said axis of rotation in a path other than orthogonal to said axis of rotation.

* * * * *